United States Patent [19]

Derichs et al.

[11] 4,102,116

[45] Jul. 25, 1978

[54] METHOD AND APPARATUS FOR CONTROLLING A THREAD-JOINING OPERATION IN ROTOR SPINNING MACHINES

[75] Inventors: Josef Derichs; Hans Raasch; Ludwig Neuhaus; Dieter Langheinrich, all of Monchen Gladbach; Helmut Schlösser, Viersen; Erwin Baltsch, Nettetal, all of Germany

[73] Assignee: W. Schlafhorst & Co., Monchen-Gladbach, Germany

[21] Appl. No.: 768,496

[22] Filed: Feb. 14, 1977

[30] Foreign Application Priority Data

Feb. 14, 1976 [DE] Fed. Rep. of Germany ..... 2605978

[51] Int. Cl.[2] ..... D01H 15/00; D01H 13/32

[52] U.S. Cl. ..... 57/34 R; 57/58.95; 57/156

[58] Field of Search ..... 57/34 R, 58.89, 58.95, 57/78, 156

[56] References Cited

U.S. PATENT DOCUMENTS

| | | | |
|---|---|---|---|
| 3,704,579 | 12/1972 | Tooka et al. | 57/34 R |
| 3,760,576 | 9/1973 | Le Chatelier et.al. | 57/34 R |
| 3,780,513 | 12/1973 | Wanatabe et al. | 57/34 R X |
| 3,878,671 | 4/1975 | Seidl et al. | 57/34 R |
| 3,987,610 | 10/1976 | Stahlecker et al. | 57/34 R |

*Primary Examiner*—Richard C. Queisser
*Assistant Examiner*—Charles Gorenstein
*Attorney, Agent, or Firm*—Herbert L. Lerner

[57] ABSTRACT

Method of controlling a thread-joining operation in a rotor-spinning machine having a rotor formed with a fiber-collecting channel, wherein a pulse proportional to the rotary speed of the rotor is applied to control a measure of the material being processed in the spinning operation which includes automatically controlling advance feeding into the rotor of a quantity of fiber required for thread-joining and feeding the fiber beginning with withdrawal of a thread formed for the fiber as well as returning into the rotor the thread end to be joined and withdrawing the joined thread from the rotor during start-up of the rotor, the automatic control being in accordance with a quantity proportional to the peripheral velocity of the fiber-collecting channel of the rotor serving as control input variable for at least one of the fiber feed, the thread withdrawal, the beginning of the advance feeding and the beginning of the returning of the thread end, and device for carrying out the method.

29 Claims, 6 Drawing Figures

Figures 1A, 1B, 1C:
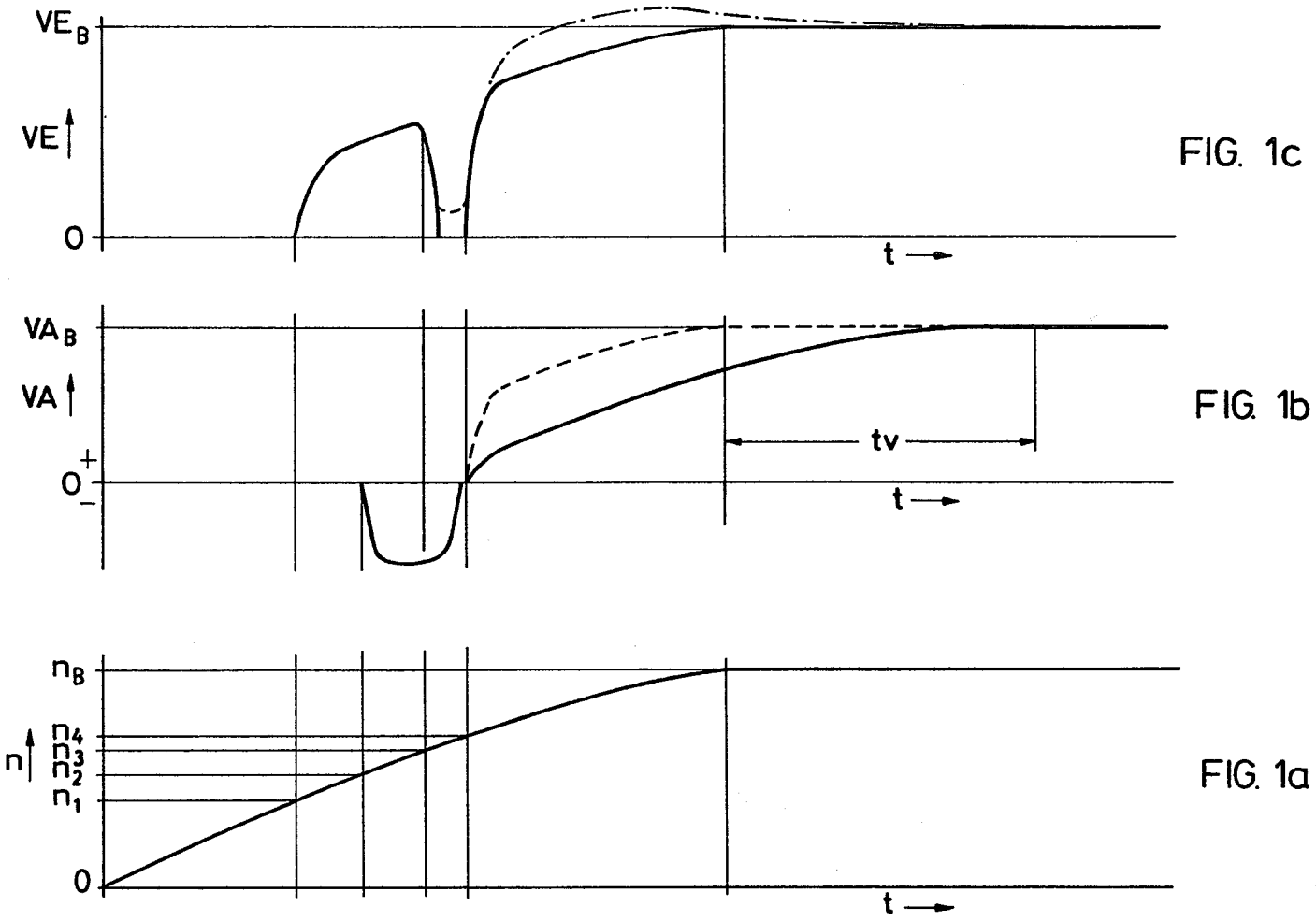

VE_B
VE
0
t

VA_B
VA
+
0
-
tv
t n_B
n
n4
n3
n2
n1
0
t

METHOD AND APPARATUS FOR CONTROLLING A THREAD-JOINING OPERATION IN ROTOR SPINNING MACHINES

The invention relates to a method and apparatus for controlling the thread-joining process in rotor-spinning machines.

It is generally known that at high rotor speeds, the joining of threads manually is virtually no longer possible.

According to patent application Ser. No. 658,895 of J. Derichs, one of the coinventors of this application, there was proposed, a method for automatizing or controlling the thread joining in a rotor-spinning machine, which includes applying a pulse proportional to the rotary speed of the spinning machine rotor for controlling the thread-joining operation, and in particular, for controlling a measure of the material being processed in the spinning operation such as the fiber feed to the rotor and/or the thread withdrawal from the rotor. For this purpose, there was proposed, in particular, a device for carrying out the foregoing method including pulse generating means for generating pulses with a frequency proportional to the rotor speed of the spinning machine rotor, and means actuable by the pulses for influencing a measure of the material being spun in the spinning operation.

It is an object of the invention to improve the proposed method and the proposed apparatus further with the goal of better matching the nature and quality of the thread joining station to the nature and quality of the spun thread.

With the foregoing and other objects in view, there is provided, in accordance with the invention, a method of solving the foregoing problem by providing that the initial feeding of the quantity of fiber required for the thread-joining into the rotor and the feeding of fiber from the start-up of the thread withdrawal, as well as the returning into the rotor of the thread end to be joined, and the thread withdrawal from the rotor during the starting-up of the rotor are automatically controlled, a quantity proportional to the peripheral velocity of the fiber-collecting channel of the rotor, and preferably, the rotary speed of the rotor, serving as control input variable for the fiber feeding, the thread withdrawal, the start-up of the advance fiber feeding and the start-up of the return of the thread end, singly or in combination.

It is advantageous, in accordance with another feature of the invention, when predetermined values of the control input variable are attained, to start the advance feeding into the rotor of a quantity of fiber required for joining the thread and then, the return of the thread end to be joined; to reduce the velocity of advance feeding independently of the start of the return; to interrupt it if necessary; then to start the withdrawal of the thread from the rotor; and to restart the thread feeding simultaneously or cancel the reduction in velocity thereof, respectively.

A variable operating time is attained for the fiber feed until the interruption. Also, the operating time of the return of the thread end to be joined is generally variable.

At the time of the interruption or reduction in velocity, respectively, of the fiber feed, the fiber collecting channel of the rotor contains the amount of fibers required for the thread-joining. The amount of fibers is approximately proportional to the number of rotor revolutions during the fiber feeding. Since the start-up characteristic of the rotor is approximately constant, the fed-in amount of fibers is with sufficient accuracy, also proportional to the difference of specific values of the rotor speeds attained during the start-up.

In a further embodiment of the invention, it is proposed that, after the start of the fiber feeding, the velocity of the latter is increased to the point that the ratio of the instantaneous values of the velocity of the fiber feeding to the instantaneous values of the control input variable, e.g., the rotor speed, is equal to the ratio attained after the start-up phase of the normal operating value of the velocity of the fiber feeding to the normal operating value of the control input variable. In addition, it is proposed, in accordance with the invention, that after the start of the advance fiber feeding, the velocity of the latter is increased to the point that the ratio of the instantaneous values of the velocity of the advance fiber feeding to the instantaneous values of the control input variable is constant but smaller than the ratio, attained after the start-up phase, of the operating value of the fiber feeding velocity to the operating value of the control input variable.

The fiber feeding should therefore follow the control input variable after the thread-joining, and the advance fiber feeding prior to the thread joining also, but with a smaller proportionality factor, so that advantageously, not too large an amount of fibers gets into the rotor until the instant of thread joining.

To avoid the formation of thin sections in the thread that might occur during the thread-joining operation, it is proposed, in accordance with the invention, that the start-up time of the thread withdrawal be lengthened with respect to the start-up time of the fiber feeding.

During the start-up, the proportionality factor, for example, can increase gradually and then remain constant at the level reached. Thus, the thread withdrawal initially takes place more slowly, so that the thin section in the thread, which occurs without this measure, is equalized. As an alternative thereto, according to the invention, the thread withdrawal velocity can be controlled proportionally to the peripheral velocity of the fiber-collecting channel or to the rotary speed of the rotor, but with a predetermined lenghtening of the start-up time.

The disadvantage of a deficiency in the amount of fibers can also be mitigated by the provision, in accordance with the invention, that during a limited time after the start of the fiber feeding, the ratio of the instantaneous values of the fiber feeding velocity to the instantaneous values of the control input variable is larger than the ratio attained after the start-up phase, of its normal operating value to the normal operation value of the control input variable, while simultaneously, after the start of the thread withdrawal, the velocity of the latter is increased to the point that the ratio of the instantaneous values of the thread withdrawal velocity to the instantaneous values of the control input variable is equal to the ratio attained after the start-up phase of the operating values of the thread withdrawal velocity to the operating value of the control input variable.

One can therefore selectively delay the thread withdrawal, for example, in the case of a fiber feed, directly proportionally to the rotary speed of the rotor, initially during a limited time period or, conversely, in the case of a thread withdrawal, directly proportionally to the rotary speed of the rotor, one can initially delay the fiber feeding. Also, a combination of the two measures is possible and could be advantageous, particularly with respect to expanding the possibility of adjusting the ratio of the fiber feeding to the thread withdrawal operation advantageously during the start-up phase.

It is advantageous to provide for the operating time of the return into the rotor of the thread end to be joined to be in accordance with the thread length to be returned, so that there is a time span of several milliseconds between the end of the return and the beginning of the thread withdrawal. In this time interval, the thread-joining per se takes place.

It is advantageous if the velocity of the return into the rotor of the thread end to be joined is controlled proportionally to the control input variable. In the case of a rotor which starts up faster, the return therefore takes place faster, and it is slower in the case of a rotor that starts up more slowly.

In a further embodiment of the invention, it is proposed that the control of the thread-joining process be programmed; quantities proportional to the delay and the rotation of the thread as well as, if applicable, to the diameter of the fiber collection channel are entered into the program as additional control variables. Since the rotation is determined by the ratio of the operating speed of the rotor to the operating velocity of the thread withdrawal and the delay by the ratio of the operating speed of the rotor to the operating velocity of the fiber feed or of the operating velocity of the thread withdrawal to the operating velocity of the fiber feed, quantities proportional to these ratios can thus be entered as additional control variables into the program. If the invention is applied, the result is that also that condition is advantageously fulfilled, that the delay and the rotation remain the same if the operating speed of the rotor is changed.

Since, normally, not all of the spinning stations of a rotor spinning frame have a thread break at the same time, the thread-joining is advantageously performed by a movable thread-joining device which services a plurality of spinning stations sequentially as to time. Separate drive devices are advantageously used for the fiber feed and the thread withdrawal or the return of the thread end to be joined, respectively.

According to a further feature of the invention, quantities proportional to the operating speed of the thread withdrawal, the operating speed of the fiber feed and the operating rotary speed of the rotor are taken, for controlling the thread-joining operation, from the central or main drive of the rotor spinning machine, are fed to the thread-joining device and used as further control input variables.

The transition from the thread-joining operation to normal operation takes place without friction, and the desired data of the fiber feeding and the thread withdrawal need not be set manually at the thread-joining device, so that this feature of the invention signified an advance in direction toward automation of the thread-joining operation.

Also, the servicing of several spinning frames by a thread-joining device travelling from one spinning frame to another is possible without the need for setting desired data each time by hand.

Although the trend today is toward digital control devices, it is particularly economical, in the case of the present invention, to effect the control of the thread-joining operation analogically.

A device, according to the invention, for carrying out the proposed method has as a feature thereof that there is associated with the rotor spinning machine, a control device for controlling the advance feeding into the rotor of a quantity of fibers required for the thread-joining, and the fiber feeding from the start of the thread withdrawal, as well as also the return into the rotor of the thread end to be joined and the thread withdrawal from the rotor, the control device for the control, during start-up of the rotor, being programmable, and the thread withdrawal velocity as well as the fiber feeding velocity being changeable by a quantity proportional to the peripheral velocity of the fiber collecting channel of the rotor, preferably the rotary speed of the rotor, as the control input variable.

Advantageously, the control device of the invention is constructed for issuing commands for starting the advance feeding of an amount of fibers required for thread joining, and for returning the thread end to be joined into the rotor; and a command for reducing or interrupting the advance feed independently of the start of the return, for the subsequent starting of the thread withdrawal from the rotor and the simultaneously renewed start, respectively, for cancelling the reduction of the fiber feed, the issuance of the commands being in each case dependent upon attaining predetermined values of the control input variable.

One advantageous embodiment of the invention comprises means for controlling the instantaneous value VE of the velocity of the fiber feed during the start-up in such a manner that the ratio of the aforementioned instantaneous value VE to the instantaneous values $n$ of the control input variable is equal to the ratio of the normal operating value $VE_B$ of the fiber feeding velocity, attained after the start-up phase, to the operating value $n_B$ of the control input variable, i.e.:

$$VE/n = VE_B/n_B$$

After the start of the fiber feed, the velocity thereof is to be increased as fast as possible so that the hereinaforementioned ratio is attained. From then on, the ratio attained should remain contant at every instant of the further start-up operation.

Another embodiment of the invention comprises means for controlling the advance fiber feeding after the start in such a manner that the ratio of the instantaneous values $VE_V$ of the velocity thereof to the instantaneous values $n$ of the control input variable is constant but smaller than the ratio, attained after the start-up phase, of the operating value $VE_V$ of the fiber feeding velocity to the operating value $n_B$ of the control input, i.e:

$$VE_V/n = \text{const} < VE_B/n_B.$$

After the start of the advance fiber feeding, the velocity of the latter should be increased as rapidly as possible until a predetermined ratio smaller than $VE_B/n_B$ is attained. From then on, the ratio attained should remain constant at every instant of the further start-up operation of the advance fiber feeding.

Advantageously, the proposed device has means for lengthening the start-up time of the thread withdrawal relative to the start-up time of the fiber feeding.

It may be advantageous if the device has means for making the operating time of the return of the thread end to be joined such that there is a time span of several milliseconds between the end of the start of the thread withdrawal. Reliable joining of large amount of fibers, that are not excessive, to the thread end to be joined is thereby ensured.

According to a further proposal, one embodiment of the invention comprises means for controlling the velocity of returning into the rotor the thread end to be joined, proportionally to the control input variable. This ensures that the thread return also is matched to the start-up characteristic of the rotor.

One variant of the invention comprises means for controlling the instantaneous values of the fiber feeding velocity in such a manner that, during a limited period of time after the start of the fiber feeding, the ratio of the instantaneous values of the fiber feeding velocity to the instantaneous values of the control input varible is larger than the ratio attained after the start-up phase of the operating value thereof, to the operating value of the control input variable, while, simultaneously, means are provided at the control device for controlling the instantaneous values of the thread withdrawal velocity in such a manner that, after the start of the thread withdrawal, the velocity of the latter is increased so that the ratio of the instantaneous values thereof to the instantaneous values of the control input variable is equal to the ratio, attained after the start-up phase of the operating value thereof, to the operating value of the control input variable.

Another variant of the invention comprises means for programming the control of the thread-joining operation and means for entering into the program quantities proportional to the delay and the rotation of the thread as well as, optionally, to the diameter of the fiber-collecting channel of the rotor, as additional control inputs.

According to a further feature of the invention, the control device comprises means for taking quantities proportional to the operating speed of the thread withdrawal, the operating velocity of the fiber feeding and the operating rotary speed of the rotor from the central or main drive of the rotor spinning machine, and means for taking these quantities over automatically for use as further control inputs.

It is advantageous, in accordance with the invention, for the control device to be associated with a travelling thread-joining device which services a plurality of spinning stations sequentially as to time.

If, in accordance with a further feature of the invention, the device according to the invention is constructed as an analog control device, one obtains, besides the economic advantages mentioned, also advantages of a technical nature, for example, with respect to simple adjustment.

With the thread-joining device there can advantageously be associated a thread-returning device equipped with a thread length measuring device, for returning into the rotor the thread end to be joined. This thread length measuring device should operate very precisely, for example, on basic principles of digital pickup and counting.

Since it is not advantageous to influence the drive motors or power transmission means of the spinning machine for the purpose of thread-joining, it is further proposed that a separate drive motor each for driving the fiber feeding and the thread withdrawal during the thread-joining process be associated with a movable thread-joining device. The motor for the thread with withdrawal is advantageously constructed as a reversible motor. It serves simultaneously as the motor for returning the thread end to be joined. The motors are advantageously constructed as fast-starting motors, with the speed thereof advantageously adjusting itself proportionally to the voltage applied. For this purpose, a separate control circuit may be provided. In a further embodiment of the invention, it is proposed that a first- or higher-order delay member or a function generator be used as the means for lengthening the start-up time of the thread withdrawal with respect to the start-up time of the fiber feed. The function generator, in turn, may be controlled by a control input.

It is further proposed that coefficient potentiometers be used as means for setting or correcting the proportionally factor and for setting or correcting the advance fiber feeding. Since the output voltage in these potentiometers is proportional to the input voltage by a selectable factor smaller than one, the proportionality is assured.

For the case that the thread-joining device is to be used for different spinning machines, where different batches with different delay and/or different rotation may be run on these machines, as well as to facilitate the transition from thread-joining operation to normal operation, it is proposed that there be associated with the central or main drive for the fiber feeding of the rotor spinning frame, a speed pickup which generates an electric voltage proportional to the rotary speed, which can be fed by means of a power transmission line to multipliers associated with the thread-joining device for controlling the motor for the fiber feed as a further control input variable and that there be associated with the central or main drive for the thread withdrawal of the rotor spinning machines, a speed pickup which generates a voltage proportional to the rotary speed, which can be fed by means of a power transmission line to a multiplier associated with the thread-joining device for controlling the motor for the thread withdrawal, as a further control input. Tachometer generators, for example, can serve as speed pickups.

It may be advantageous to have available the operating value of the control input also if the rotor of the spinning station to be serviced does not rotate at the operating speed. It is therefore proposed, as a further feature of the invention, that a memory or storage means for the operating value of the control input variable be associated with the control device. As an alternative thereto, there can also be advantageously associated with the central or main drive for the rotor rotation, a speed pickup which generates a voltage that is proportional to the rotary speed and can be fed by means of a power transmission line to dividers associated with the thread-joining device for controlling the motors for the fiber feed and the thread withdrawal, as a further control input.

The advantages obtained with the invention are, in particular, that the nature and the quality of the thread joinder is matched to the nature and quality of the spun thread as accurately as possible, no resetting or new adjustment being generally required at the thread-joining device or the control device, if the operating speed of the rotor is changed or a batch is changed. Therefore, the invention is also advantageously suited for automating the thread-joining operation.

With the invention, thread joining devices of such high quality are able to be produced, that cleaning of the thread-joining devices later is not necessary.

Other features which are considered as characteristic for the invention are set forth in the appended claims.

Although the invention is illustrated and described herein as embodied in a method and apparatus for controlling a thread-joining operation in rotor spining machines, it is nevertheless not intended to be limited to the details shown, since various modifications may be made therein without departing from the spirit of the invention and within the scope and range of equivalents of the claims.

Figure 2:
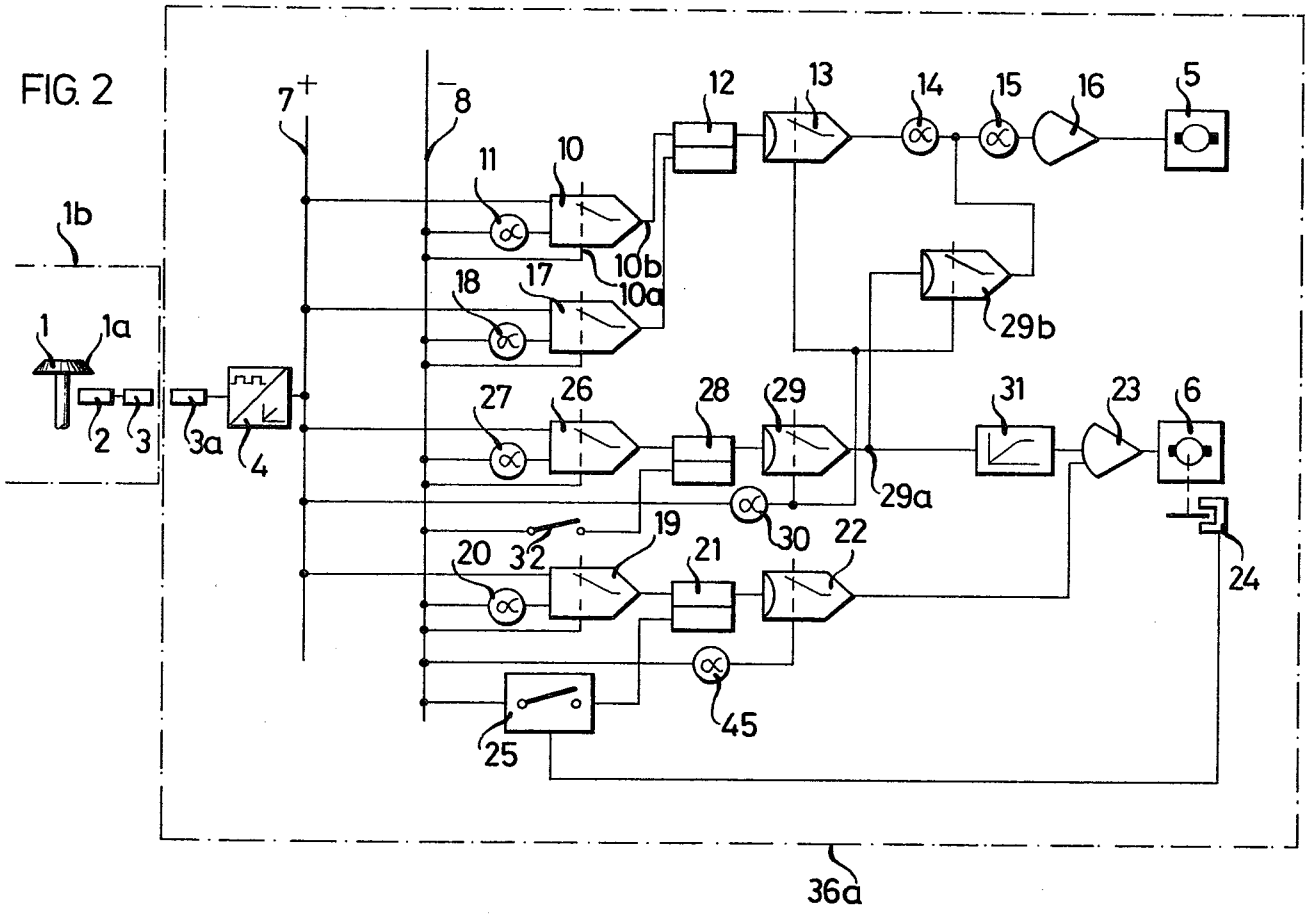
Figure 3:
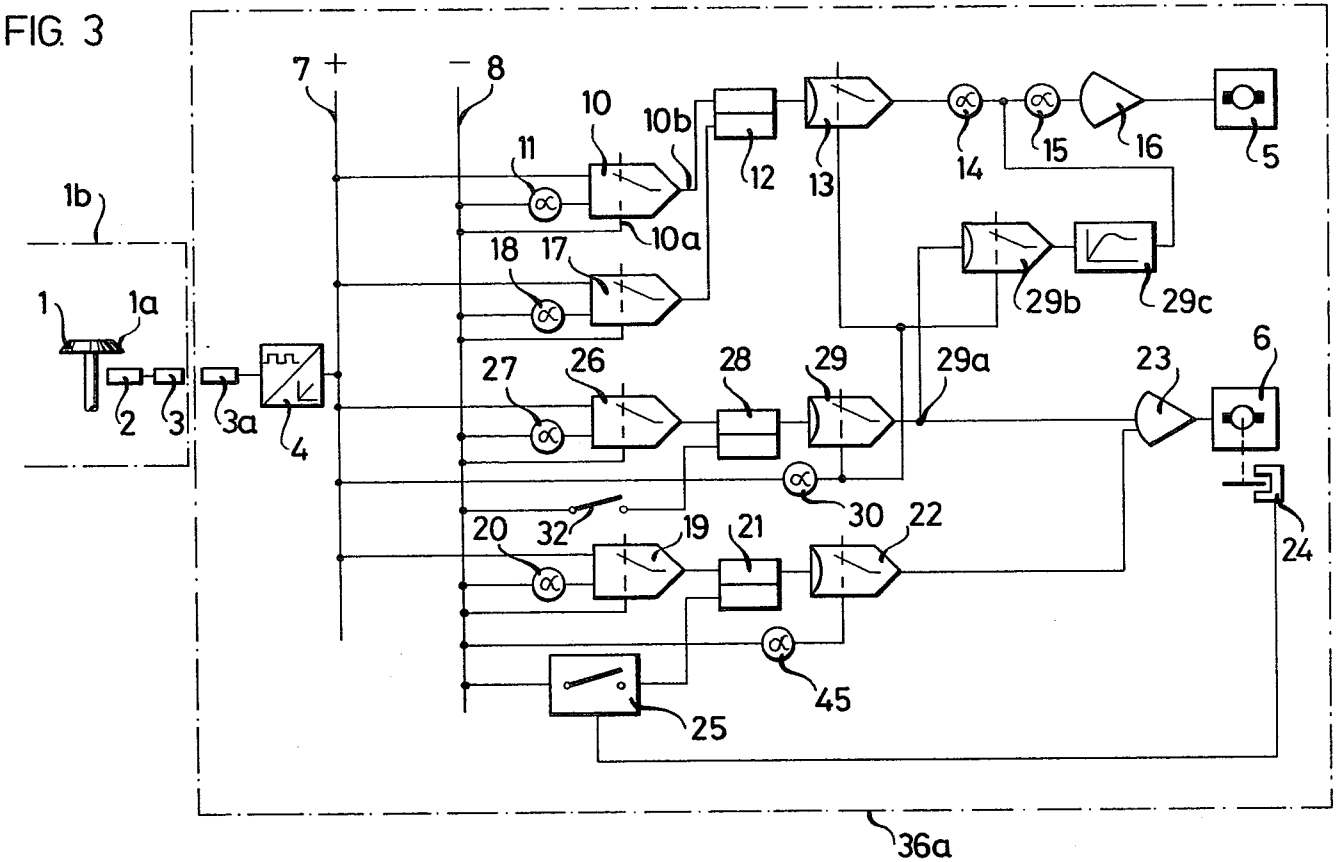
Figure 4:
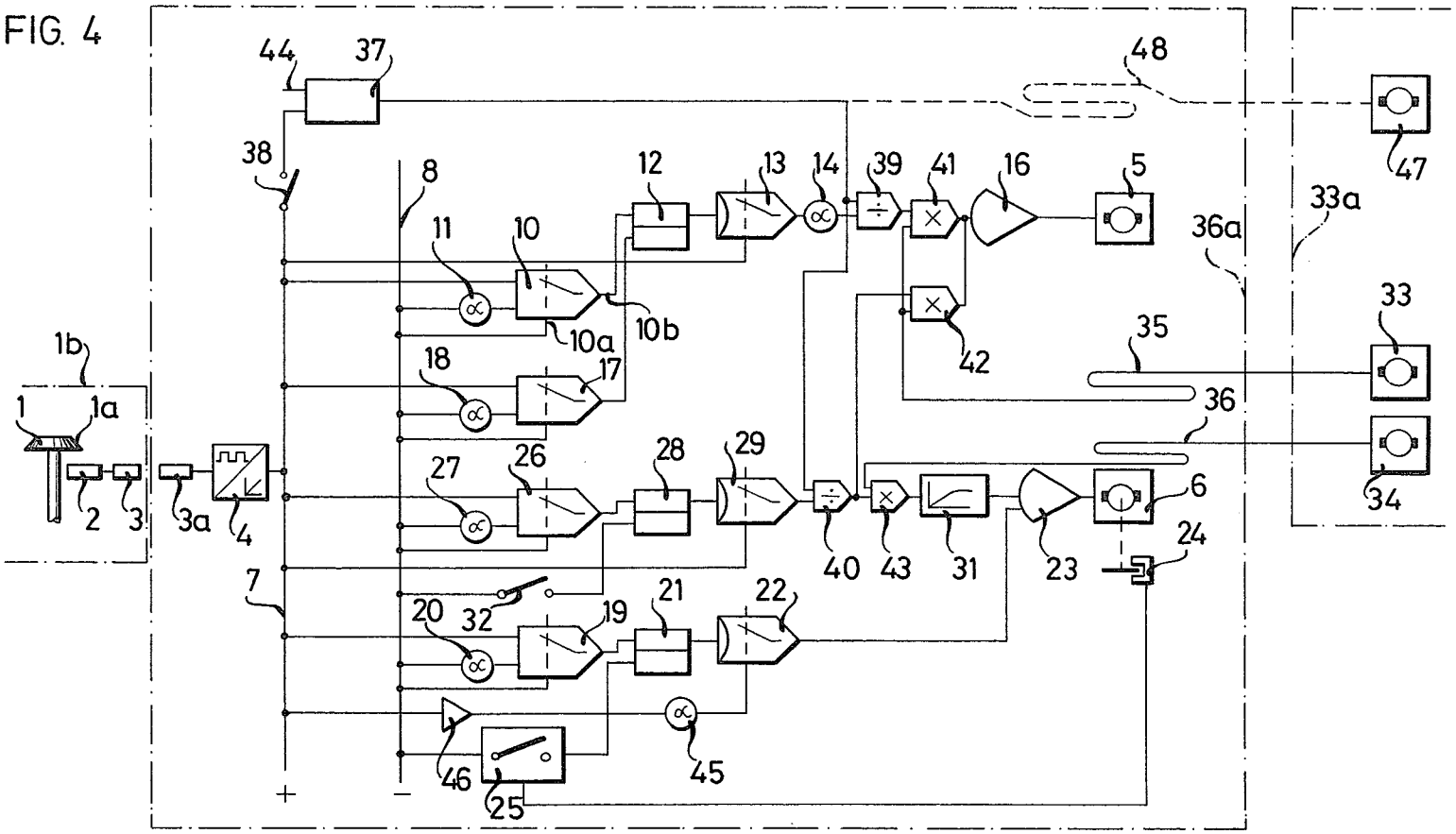

The invention, however, together with additional objects and advantages thereof will be best understood from the following description when read in connection with the accompanying drawings, in which:

FIGS. 1*a*, 1*b* and 1*c* are respective plot diagrams of the rotor speed, the thread withdrawal velocity (or the return velocity of the thread end to be joined), and the fiber feeding velocity on the same time scale shown along the abscissa; and FIGS. 2 to 4 are circuit or block diagrams of different embodiments of control devices according to the device of the invention.

Referring now to the drawing and first, particularly, to FIGS. 1*a*, 1*b* and 1*c*, it is noted that fiber advance feed is started at a rotor speed $n_1$, the drive motor of the fiber feed accelerating until the ratio of the instantaneous values $VE_V$ of the velocity of the advance feeding to the instantaneous values $n$ of the control input variable is constant but smaller than the ratio, attained after the acceleration phase, of the operating fiber-feeding velocity value $VE_B$ to the operating value $n_B$ of the control input variable, which, in this case, is the rotary speed of the rotor. After a short start-up phase, the proportional fiber advance feeding velocity is attained, whereupon the fiber advance feeding velocity continues to rise proportionally to the rotor speed. At a rotor speed $n_3$, the fiber advance feed is switched or cut off in order to allow undisturbed joining of the thread.

The optimal amount of fibers which must be fed-in beforehand in order to obtain a good thread joint can be determined empirically. The switch-on switch-off time of the fiber advance feed should be as far apart as possible, so that the irregularities of the fiber supply caused by the starting up and running out of the fiber advance feed do not lead to disturbances of the thread-joing operation.

The thread end to be joined was previously placed in readiness by the thread-joining device. The instant the rotor speed $n_2$ is attained, the return of the thread end to be joined into the rotor is started. This is accomplished, for example, in that the rollers of the thread withdrawal device, which hold the end of the thread are switched on or started up, in a conventional manner, in a direction of rotation opposed to that of the withdrawal. The curve of the return velocity of the thread end to be joined is shown in FIG. 1*b*. It is seen from FIG. 1*b* that there is a short pause between the end of the return and the beginning of the thread withdrawal. The return should be carried out at high speed. The length of the thread end fed into the rotor can be determined, for example, by digitally picking-up or establishing the rotary angle of the withdrawal roller.

After the returned thread end has joined with the ring of fibers present in the fiber collecting channel of the rotor, both the thread withdrawal and, the fiber feed proper are simultaneously started when the rotor speed $n_4$ is attained. It is also possible and permissible merely to reduce the fiber advance feed and to let it thereafter merge into the fiber feed proper, as the curve represented by the dot-dash line of FIG. 1*c* indicates, for example. The velocity of the fiber feed is then also brought as fast as possible up to a value which is at the same ratio to the operating velocity $VE_B$ of the fiber feed as the instantaneous rotor speed is to the operating rotor speed $n_B$. Thereafter, the fiber feed curve has a course such that the ratio of the instantaneous values thereof to the instantaneous values of the control input variable is equal to the ratio, attained after the acceleration phase, of the operating value thereof to the operating value of the control input variable.

If one were to control or regulate the thread withdrawal velocity from the start, after a short acceleration phase, also with a constant proportionality factor proportionally to the rotor speed, as shown in FIG. 1*b* by a broken line, then the withdrawn thread would be thinner than normal. As one cause thereof, it was found that a change in the feed velocity results in a change in the amount of fibers getting into the fiber-collecting channel of the rotor only after a time delay, because the fibers must first be transported from the breakup or loosening-up point to the fiber collecting channel.

The start-up time of the thread withdrawal is therefore flattened out in accordance with the invention and, thereby, for all practical purposes, the start-up of the thread withdrawal is lengthened by a time $t_v$ with respect to the start-up of the fiber feed, so that the operating withdrawal velocity $VA_B$ is attained only delayed by the delay time $t_v$, as compared to the time at which the operating speed $n_B$ of the rotor was attained. Thereby, the amount of fibers which is initially lacking yet in the rotor is compensated for by a lesser thread withdrawal. The disadvantage of a lacking quantity of fibers can also be mitigated by providing that, during a limited period of time after the start of the fiber feed, the ratio of the instantaneous values of the fiber feed velocity to the instantaneous values of the control input variable is larger, in accordance with the invention, than the ratio, attained after the start-up phase, of the operating value thereof to the operating value of the control input variable, as shown by the dot-dash curve in FIG. 1*c*.

It is apparent from the presentations in FIGS. 1*a*, 1*b* and 1*c*, that the thread-joining operation can be defined by the fixed, predetermined rotor speeds $n_1$, $n_2$, $n_3$, $n_4$ and the rotor operating speed $n_B$, the thread-withdrawal operating speed $VA_B$, the fiber-feed operating speed $VE_B$ and, if necessary, by the rotor radius.

As has been learned from experience, a thread can be joined most reliably at a rotor speed of 30,000 to 40,000 RPM. Therefore, the speeds $n_1$ to $n_4$ should lie in this range of rotary speds. In this range, the start-up of the rotor is also very uniform, independently of the operating speed $n_B$, so that the speeds $n_1$ to $n_4$ can be predetermined as fixed values for control purposes. If a traveling thread-joining device is introduced, the rotor speed of the spinning stations to be serviced is transmitted individually through an information data channel to the thread-joining device. The information exchange preferably occurs without physical contact, i.e., contactless.

FIG. 2 shows a circuit or block diagram of a control device according to the invention for analog control of the thread-joining operation according to FIGS. 1*a*, 1*b* and 1*c*. A rotor 1 is shown in FIG. 2 within a spinning station 1*b*, and has a fiber collecting channel 1*a*.

From the rotor 1, digital pulses which are proportional to the rotor speed are received through a pickup 2 and are transmitted by a transmitter 3, 3*a* without physical contact from the spinning station 1*b* to the input of a digital-to-analog converter 4, which delivers at the output thereof a *d–c* voltage proportional to the rotary speed of the rotor.

A *d–c* motor 5 serves to drive the non-illustrated conventional fiber feed, and a *d–c* motor 6 to drive a conventional thread-withdrawal and thread-return device. The *d–c* motor 6 is constructed as a reversible motor. The motors are of such construction that they have a short start-up time and the speed thereof then adjusts itself proportionally to the applied *d–c* voltage.

Due to the collection of the line 7 to the output of the digital-to-analog converter 4, a *d–c* voltage proportional to the rotor speed is always present at the line 7. This *d–c* voltage has, for example, a positive polarity. The line 8 carries a constant *d–c* voltage of opposite polarity. The magnitude of this voltage is at least equal to the magnitude of the maximal voltage of the line 7.

One control input of a comparator 10 is connected to the line 7, and a second control input thereof to the line 8 through a coefficient potentiometer 11. The input of the comparator 10 that is to be switched is likewise connected to the line 8. As soon as the sum of the voltages present at the control inputs of the comparator 10 falls below the value 0, the input 10*a*, that is to be switched, is connected to the output 10*b*. The potentiometer 11 is set so that the comparator 10 switches over just when the rotor 1 has reached the speed $n_1$ (FIG. 1*a*) during start-up, and the line 7 carries a voltage of corresponding magnitude.

As soon as the comparator 10 has switched over, the following or after-connected memory 12 is set, which switches-on a digital-analog switch 13. The input to the switch 13 that is to be switched is connected to the line 7 through a coefficient potentiometer 30. The output of the switch 13 is connected to the *d–c* motor 5 through the coefficient potentiometers 14 and 15 and an amplifier 16. The potentiometer 15 serves for setting the operating speed $VE_B$ of the fiber feed (FIG. 1*c*). The potentiometer 14 serves additionally for setting the fiber advance feeding.

In a manner similar to that in the case of the comparator 10, control inputs of comparators 17, 26 and 19 are also connected to the lines 7 and 8. The same applies to the inputs to be switched that are all connected to the line 8. The potentiometer 18 is set so that the comparator 17 switches over just when the rotor has attained the speed $n_3$ (FIG. 1*a*) during start-up. The output of the comparator 17 is connected to the clearing input of the memory 12. As soon as the rotor speed $n_3$ is attained, the output of the comparator 17 carries voltage, the memory 12 is cleared and the advance feeding is therewith completed.

A potentiometer 20 is set so that the comparator 19 switches over just when the rotor 1 has attained the speed $n_2$ (FIG. 1*a*) during start-up. The output of the comparator 19 is connected to a memory 21. As soon as the output of the comparator 19 carries voltage, the memory 21 is set and the after-connected digital-analog switch 22 is switched on. The input of the switch 22 that is to be switched is connected to the line 8 through a coefficient potentiometer 45. The output of the switch 22 is connected through an amplifier 23 to the *d–c* motor 6. As soon as the connection to the line 8 is established, the *d–c* motor 6 starts up and runs opposite the thread withdrawal direction for the purpose of returning the thread. A thread-length measuring device 24, constructed as a pacer or step transmitter, is connected to the control input of a counter 25. If a preselected number of steps is reached, which corresponds to the desired, fed-back thread length, then the clearing input of the memory 21 obtains voltage from the line 8 through the counter 25, so that the memory is cleared and the switch 22 opens. After the switch 22 is switched off, the *d–c* motor 6 stops immediately, which can be effected, for example, by means of a conventional brake-lifting device.

The coefficient potentiometer 27 is set so that the comparator 26 switches over just when the rotor 1 has reached the speed $n_4$ (FIG. 1*a*) during starting-up. After the comparator 26 has switched over, the output thereof carries voltage, due to which an after-connected memory 28 is set, so that the digital-analog switch 29 is switched on. The input of the latter that is to be switched is connected to the line 7 through a coefficient potentiometer 30. After the switch 29 is switched on, a voltage lower than the voltage of the line 7 by a factor smaller than one is present at a branching point 29*a*. One branch line leads from the latter through a digital-analog switch 29*b* to the input of the potentiometer 15 and the other branch, through a first-order delay member 31 and the amplifier 23, to the *d–c* motor 6.

As soon as the branching point 29*a* carries voltage, the switch 29*b* is switched on, so that the *d–c* motor 5 receives voltage through the potentiometer 15 and the amplifier 16 from the output of the potentiometer 30. The *d–c* motor 5 brings the fiber feed quickly to a speed which is at the same ratio to the instantaneous rotor speed as the operating speed $VE_B$ (FIG. 1*c*) is to the rotor operating speed $n_B$ (FIG. 1*a*). The operating velocity $VA_B$ of the thread withdrawal is set (FIG. 1*b*) at the potentiometer 30. The delay member 31 flattens out the rise of the input voltage of the *d–c* motor 6, for example, according to an exponential function. This increases the start-up time of the thread withdrawal with respect to the start-up time of the fiber feed.

When the switch 32 is closed, the memory 28 is cleared, so that the switch 29 reopens and the *d–c* motors 5 and 6 come to a stop. This is the case after the transfer of the joined or pieced thread to the spinning station and after the simultaneous switch-over of the fiber feed to the fiber feed drive of the spinning station.

The setting or adjustment of the coefficient potentiometers 11, 18, 20, 27 and 45 for the rotor speeds $n_1$ to $n_4$ and the velocity of the return of the thread end that is to be joined need ordinarily be effected only once. Normally, only the potentiometers 15 and 20 are reset for the purpose of changing the delay and the rotation of the thread.

Alternatively, the circular or block diagram of FIG. 2 could be modified so that the potentiometer 30 is disposed between the branching point 29*a* and the delay member 31. After the switch 29 is switched on, the voltage of the line 7 is then present at the branching point 29*a*. The operating velocity of the thread withdrawal is thereby set at the potentiometer 30 and the operating velocity of the fiber feed at the potentiometer 15. The relationship between the rotor speed, the thread withdrawing velocity and the fiber feeding velocity remains constant thereat. It is therefore possible to vary the rotor speed, for a given rotation and given delay, also with this circuit variant, without having to change the setting at the thread-joining device.

If the diameter of the fiber collecting channel 1*a* of the rotor 1 is to be changed, the setting of the potentiometer 14 and of the counter 25 can be changed. Since the rotor diameters are ordinarily changed in steps, the changes of the settings could also be effected through a common step switch.

The *d–c* motors 5 and 6 are in operation only during the thread joining process. After the thread-joining, the fiber supply and the thread withdrawal are carried out by non-illustrated associated drives of the spinning machine.

In the embodiment of the control apparatus according to FIG. 3, largely the same components are used in the same circuit for the same purpose as in the device according to FIG. 2. Like components are provided in FIG. 3 with the same reference numerals as in FIG. 2, so that a description and explanation of the function and connection of these components are not necessary at this point.

Deviating from the circuit and arrangement in FIG. 2, the delay member 31 is omitted in the embodiment of the invention shown in FIG. 3. A higher-order delay member **29*c* is inserted instead into the line leading from the output of the digital-analog switch 29*b* to the input of the coefficient potentiometer 15**.

As soon as the branching point **29*a* carries voltage, the switch 29*b*** is switched on, so that, simultaneously with the start-up of the *d–c* motor 6 for the thread withdrawal, the *d–c* motor 5 for the fiber feed also receives voltage. The delay member **29*c*** is set or adjusted so that during a limited period of time after the start of the fiber feed, the ratio of the instantaneous values of the fiber feeding velocity to the instantaneous values of the control input is larger than the ratio, reached after the starting-up phase, of the operating value thereof to the operating value of the control input variable.

In the embodiment of the invention according to FIG. 3, the fiber feeding is therefore increased after the start, during a limited period of time, in order to prevent the occurrence of thin sections in the thread. The thread withdrawal, on the other hand, after a short start-up phase, occurs directly proportionally to the rotor speed.

The embodiment of the invention according to FIG. 4 shows, as mentioned hereinbefore, a block diagram of another embodiment of the control apparatus according to the invention. Also in the device of FIG. 4, largely the same components are used in the same circuit for the same purpose as in the device according to FIG. 2. The respective components are provided, in FIG. 4 also with the same reference numerals as in FIG. 2. In order to avoid repetition, a description and explanation of the function and connection of these components will be omitted at this point. The deviations from the circuit of FIG. 2 that exist in the embodiment of FIG. 4 relate to the circuit arrangement between the potentiometer 14 and the amplifier 16 on the one hand, and between the digital-analog switch 29 and the delay member 31 on the other hand. In addition, the return of the thread end is differently connected.

At the rotor spinning frame **33*a*, tachometer generators 33 and 34, respectively, which deliver a voltage proportional to the rotary speed and, therefore, to the velocity of the fiber feed and the thread withdrawal, respectively, are coupled to the no-longer illustrated drives of the fiber feed and the thread withdrawal. These voltages are fed through flexible or movable lines 35 and 36, respectively, to the movable thread-joining device 36*a*. These voltages drive the amplifiers 16 and 23 in such a manner that the fiber feeding velocity and the thread withdrawal velocity of the movable thread-joining device 36*a* are equal to those of the rotor spinning machine if the rotor runs at the operating speed $n_B$ thereof (FIG. 1*a***).

If the thread-joining device **36*a* corrects a thread break at a spinning station, for example, the spinning station 1*b*, then the rotor 1** continues to run initially at the operating speed $n_B$. The *d–c* voltage which is then carried by the line 7 and is proportional to the speed of the rotor 1, is switched to a memory 36 through a switch 38 which is closed by the mechanism of the thread-joining device **36*a*. Before the rotor 1 is braked, the switch 38 is reopened, so that the voltage carried up to that instant by the line 7 remains stored to the full magnitude thereof in the memory 37. If the switches 13 and 29, respectively, are closed, a ratio between the instantaneous value of the voltage present on the line 7 and the voltage stored by the memory 37, which is proportional to the operating speed of the rotor 1, is formed in the dividers 39 and 40, respectively. The ratio voltages present at the outputs of the dividers are multiplied in the multipliers 41, 42 and 43, respectively, by the voltages of the lines 35 and 36, respectively. Since the outputs of the multipliers 41 and 42 are connected to the input of the amplifier 16, and the line 35 is connected to the inputs of the multipliers 41 and 42, there is present at the input of the amplifier 16 a voltage which has the same ratio to the voltage of the line 35 as the instantaneous speed of the rotor 1 to the operating speed $n_B$ thereof. Since, on the other hand, the output of the multiplier 43 is connected through the delay member 31 to the input of the amplifier 23, and the line 36 is tied to the input of the multiplier 43, there is present also at the input of the amplifier 23, a voltage which is at the same ratio to the voltage of the line 36 as the instantaneous rotor speed is to the operating speed $n_B$. The memory 37 is automatically cleared through the clearing input 44 after the thread joining, and is reconnected to the line 7 after the switch 38** is closed.

Instead of the memory 37, a rotary speed pickup 47, which generates a voltage proportional to the rotary speed, can be associated for the same purpose with the non-illustrated central drive for the rotor rotation. By means of a power transmission line 48, shown in broken lines, the rotary speed pickup 47 is connected to the dividers 39 and 40, associated with the thread-joining device **36*a***, and with the respective *d–c* motors 5 and 6 for the fiber feed and the thread withdrawal, i.e., a voltage proportional to the operating voltage $n_B$ of the rotor is always available at the inputs of the dividers 39 and 40.

Should difficulties arise, because of the length of the lines or for other reasons, in an individual case in the feeding of *d–c* voltages through the lines 35, 36 and 48, then, as an alternative, a conventional digital-to-analog conversion could also be performed.

The input of the digital-analog switch 22 that is to be switched is connected to the line 7, in the block diagram of FIG. 4, through the coefficient potentiometer 45 and, contrary to FIG. 2, through an inverter 46. Assurance is provided thereby that the velocity of the return of the thread end to be joined into the rotor is proportional to the rotor speed.

As mentioned hereinbefore, the invention is not limited to the embodiments shown and described. For example, the *d–c* motors, together with their input amplifiers, can alternatively form separate control loops or circuits.

There are claimed:

1. Method of controlling a thread-joining operation in a rotor-spinning machine having a rotor formed with a fiber-collecting channel, wherein a pulse proportional to the rotary speed of the rotor is applied to control a measure of the material being processed in the spinning operation which comprises automatically controlling spin feeding into the rotor of a quantity of fiber required for thread-joining and feeding the fiber beginning with withdrawal of a thread formed from the fiber, returning into the rotor the thread end to be joined and withdrawing the joined thread from the rotor during start-up of the rotor, the automatic control being in accordance with the pulse proportional to the rotary speed of the fiber-collecting channel of the rotor serving as control input variable for at least one of the fiber feed, the thread withdrawal, the starting-up of the spin feeding and the starting-up of the returning of the thread end.

2. Method according to claim 1 which includes, upon attaining respective predetermined values of the control input variable, starting-up the spin feeding into the rotor of the quantity of fiber required for thread-joining, then starting-up the return into the rotor of the thread end to be joined, selectively starting-up a reduction of the spin feeding and interrupting the spin feeding independently of the starting-up of the return of the thread end to be joined into the rotor, then starting-up the withdrawal of the thread from the rotor and simultaneously discontinuing the reduction of the spin feeding and restarting the interrupted spin feeding.

3. Method according to claim 1 which includes, after starting-up the feeding of the fiber, increasing the velocity of the fiber feeding so that the ratio of the instantaneous values of the velocity of the fiber feeding to the instantaneous values of the control input variable is equal to the ratio, after attaining the start-up phase, of the regular operating value of the velocity of the fiber feeding to the regular operating value of the control input variable.

4. Method according to claim 1 wherein, during a limited time period after the starting-up of the fiber feeding, the ratio of the instantaneous values of the fiber feeding velocity to the instantaneous values of the control input variable is greater than the ratio of the regular operating value of the fiber feeding velocity to the regular operating value of the control input variable attained after the start-up phase.

5. Method according to claim 1 which includes, after the starting-up of the spin feeding of the fiber, increasing the velocity of the spin feeding so that the ratio of the instantaneous values of the velocity of the spin fiber feeding to the instantaneous values of the control input variable is constant but smaller than the ratio, attained after the start-up phase, of the operating value of the fiber feeding velocity to the operating value of the control input variable.

6. Method according to claim 1 which includes after the starting-up of the thread withdrawal, increasing the velocity of the thread withdrawal so that the ratio of the instantaneous values of the thread withdrawal velocity to the instantaneous values of the control input variable is equal to the ratio attained, after the start-up phase, of the operating values of the thread withdrawal velocity to the operating values of the control input variable.

7. Method according to claim 1 which includes lengthening the start-up time of the thread withdrawal with respect to the start-up time of the fiber feeding.

8. Method according to claim 1 which comprises returning into the rotor the thread end to be joined at a controlled velocity proportional to the control input variable.

9. Method according to claim 1 which comprises programming control of the thread-joining operation including entering into the program, as additional control input variables, at least one, selectively, of quantities proportional to a delay and a rotation of the thread and the diameter of the fiber collecting channel.

10. Method according to claim 1 which includes, for controlling the thread-joining operation, taking proportional values of the operating velocity of the thread withdrawal, the operating velocity of the fiber feed and the operating rotary speed of the rotor from the main drive of the rotor spinning machine and applying them as additional control input variables in the foregoing steps of the method.

11. Device for carrying out a method of controlling a thread-joining operation in a rotor-spinning machine having a rotor formed with a fiber-collecting channel comprising a control device associated with the rotor-spinning machine for controlling spin feeding into the rotor of a quantity of fiber required for thread-joining, and feeding of the fiber beginning with withdrawal of a thread formed from the fiber, and for return into the rotor of the thread end to be joined and withdrawal of the joined thread from the rotor, said control device being programmable during start-up of the rotor for effecting the control, the thread withdrawal velocity as well as the fiber feeding velocity being variable by a quantity proportional to the peripheral velocity of the fiber collecting channel of the rotor as control input variable.

12. Device according to claim 11 wherein the quantity proportional to the peripheral velocity is the rotary speed of the rotor.

13. Device according to claim 11 wherein said control device has means for issuing commands for starting-up spin feeding of a quantity of fiber required for thread-joining and for returning into the rotor the thread end to be joined, and a command for selectively reducing the velocity of and interrupting the spin feeding of the fiber independently of the starting-up of the return into the rotor of the thread to be joined and of the starting-up of the withdrawal of the thread from the rotor, and for simultaneously discontinuing the reduction of the spin feeding and restarting of the interrupted spin feeding, the issuance of said commands being dependent respectively upon the attainment of predetermined values of the control input variable.

14. Device according to claim 11 comprising means for controlling the instantaneous value VE of the fiber feeding velocity during start-up so that the ratio of said instantaneous value VE to instantaneous values $n$ of the control input variable is equal to the ratio of normal operating value $VE_B$, attained after the start-up phase, of the fiber feeding velocity to normal operating value $n_B$ of the control input variable, or $VE/n = VE_B/n_B$.

15. Device according to claim 11 comprising means for controlling the instantaneous values of the fiber feeding velocity so that, during a limited time period after the starting-up of the fiber feeding, the ratio of the instantaneous values of the fiber feeding velocity to the instantaneous values of the control input variable is larger than the ratio, attained after the start-up phase, of the operating value of the fiber feeding velocity to the operating value of the control input variable.

16. Device according to claim 11 including means for controlling the spin feeding, after the starting-up thereof, so that the ratio of the instantaneous value $VE_V$ of the advance feeding velocity to the instantaneous value $n$ of the control input variable is constant yet smaller than the ratio, attained after the start-up phase, of the operating value $VE_B$ of the fiber feed velocity to the operating value $n_B$ of the control input variable, or $$VE_V/n = \text{const.} < VE_B/n_B.$$

17. Device according to claim 11 comprising means for controlling the instantaneous values of the thread withdrawal velocity in a manner that, after the starting-up of the thread withdrawal, the thread withdrawal velocity is increased so that the ratio of the instantaneous values of the thread withdrawal velocity to the instantaneous values of the control input variable is equal to to the ratio, attained after the start-up phase of the operating value of the thread withdrawal velocity to the operating value of the control input variable.

18. Device according to claim 11 comprising means for lengthening the start-up time of the thread withdrawal with respect to the start-up time of the fiber feed.

19. Device according to claim 11 comprising means for controlling the velocity of the return into the rotor of the thread end to be joined, proportionally to the control input variable.

20. Device according to claim 11 comprising means for programming the control of the thread-joining operation, and means for entering into the program quantities proportional to delay and rotation of the thread as additional control input variables.

21. Device according to claim 20 wherein said last-mentioned means are for entering into the program a quantity proportional to the diameter of the fiber-collecting channel as a control input variable.

22. Device according to claim 11 wherein the device is constructed as an analog control device.

23. Device according to claim 11 including respective electric motor means for operating said fiber feed and said thread withdrawal, said motor means having a brief start-up time and having a rotary speed proportional, to the electric voltage applied thereto.

24. Device according to claim 11 comprising means for lengthening the start-up time of the thread withdrawal with respect to the start-up time of the fiber feed, said means for lengthening the start-up time being a delay member of at least first order.

25. Device according to claim 11 comprising means for lengthening the start-up time of the thread withdrawal with respect to the start-up time of the fiber feed, said means for lengthening the start-up time being a function generator.

26. Device according to claim 11 comprising coefficient-potentiometer means for effecting variations in the proportionality factor and and in the advance feeding.

27. Device according to claim 11 wherein the rotor-spinning machine has main drive means for fiber feeding, and including a first rotary-speed pick-up associated with said main drive means for fiber feeding for generating an electric voltage proportional to the rotary speed, first multiplier means associated with the thread-joining device, a power transmission line interconnecting said first pick-up and said first multiplier means for feeding an electric voltage from said first pick-up to said first multiplier means for controlling a motor associated with said fiber feed, as an additional control input variable, and wherein the rotor-spinning machine has main drive means for thread withdrawal, and including a second rotary-speed pick-up associated with said main drive means for thread withdrawal for generating an electric voltage proportional to the rotary speed, second multiplier means associated with the thread-joining device, a power transmission line interconnecting said second pick-up and said second multiplier means for feeding an electric voltage from said second pick-up to said second multiplier means for controlling a motor associated with said thread withdrawal, as an additional control input variable.

28. Device according to claim 11 including storage means for storing an operating value of the control input variable.

29. Device according to claim 11 wherein the rotor spinning machine has a main drive for rotating the rotor, a rotary speed pick-up associated with the main drive for rotating the rotor, said pick-up having means for generating a voltage proportional to the rotary speed, divider means associated with the thread-joining device, a power transmission line connecting said pick-up to said divider means for transmitting a control voltage for controlling motors associated with said fiber feed and said thread withdrawal, as additional control input variables.

* * * * *